US009578904B2

(12) United States Patent
Bybee et al.

(10) Patent No.: US 9,578,904 B2
(45) Date of Patent: Feb. 28, 2017

(54) JERSEY

(75) Inventors: Lia Bybee, Denver, CO (US); Jennie Yu, Golden, CO (US)

(73) Assignee: DASHAMERICA, INC., Louisville, CO (US)

( * ) Notice: Subject to any disclaimer, the term of this patent is extended or adjusted under 35 U.S.C. 154(b) by 95 days.

(21) Appl. No.: 13/382,717

(22) PCT Filed: Jul. 2, 2010

(86) PCT No.: PCT/US2010/040982
§ 371 (c)(1),
(2), (4) Date: Feb. 28, 2012

(87) PCT Pub. No.: WO2011/003102
PCT Pub. Date: Jan. 6, 2011

(65) Prior Publication Data

US 2012/0304359 A1 Dec. 6, 2012

Related U.S. Application Data

(60) Provisional application No. 61/222,934, filed on Jul. 2, 2009.

(51) Int. Cl.
*A41B 1/00* (2006.01)
*A41B 3/04* (2006.01)
(Continued)

(52) U.S. Cl.
CPC ..... *A41D 1/04* (2013.01); *A41D 13/0015* (2013.01); *A41D 2400/24* (2013.01); *A41D 2600/104* (2013.01)

(58) Field of Classification Search
CPC ..... A41D 1/04; A41D 1/00; A41D 2400/24; A41D 2600/104; A41D 13/0015; A41B 1/00
(Continued)

(56) References Cited

U.S. PATENT DOCUMENTS 2,986,740 A * 6/1961 Schudson ..... A41D 27/10 2/115
3,479,245 A * 11/1969 Manock ..... D03D 15/00 139/421
(Continued)

FOREIGN PATENT DOCUMENTS

DE 202008001340 3/2008
FR 2476453 A1 * 8/1981 ..... A41D 13/02

OTHER PUBLICATIONS

Official Action for Canadian Patent Application No. 2,767,779, mailed May 21, 2013, 3 pages.
(Continued)

*Primary Examiner* — Jameson Collier
(74) *Attorney, Agent, or Firm* — Jeff Mangels; Butler & Mitchell LLP; Brennan C. Swain, Esq.

(57) ABSTRACT

An athletic jersey having at least one sleeve with a shoulder panel and sleeve panel, and a back panel having first and second back panel lateral edges mated and joined to the sleeve panel of the sleeve, and a front panel having first and second front panel side edges mated and joined to the shoulder panel of the sleeve as well as a collar edge mated and joined to the shoulder panel. The jersey has side panels mated and joined between the front panel and back panel, such that the side panel comprises a beam element and an arm element extending from the beam element and having a substantially triangular shape extending from the beam element forward about the triceps of the jersey to form the sleeve in combination with the shoulder panel and sleeve panel, substantially eliminating loose fabric about the wearer's underarm.

12 Claims, 5 Drawing Sheets

(51) Int. Cl.
*A41D 27/24* (2006.01)
*A41D 1/04* (2006.01)
*A41D 13/00* (2006.01)

(58) Field of Classification Search
USPC ..... 2/115, 129, 77, 69, 93, 103, 116, 275
See application file for complete search history.

(56) References Cited

U.S. PATENT DOCUMENTS 3,835,470 A * 9/1974 Greiter ..... 2/79
4,249,268 A * 2/1981 Berler ..... A41D 1/04 2/115
4,764,986 A * 8/1988 Stewart ..... 2/115
5,033,116 A * 7/1991 Itagaki et al. ..... 2/67
5,406,647 A * 4/1995 Lew ..... 2/69
6,438,755 B1 * 8/2002 MacDonald et al. ..... 2/69
6,892,396 B2 * 5/2005 Uno ..... A41D 13/0015 2/115
7,310,824 B2 * 12/2007 Walsh ..... 2/122
D602,677 S * 10/2009 Cowan ..... D2/731
7,636,950 B2 * 12/2009 Melhart et al. ..... 2/69
D608,077 S * 1/2010 Bybee et al. ..... D2/717
7,941,869 B2 5/2011 Wright et al.
D661,054 S * 6/2012 Minamijima et al. ..... D2/717
8,286,262 B2 * 10/2012 Rance et al. ..... 2/67
D674,168 S * 1/2013 Kajino et al. ..... D2/840
D691,782 S * 10/2013 Meredith ..... D2/840
2006/0048263 A1 * 3/2006 Walsh ..... 2/69
2006/0230490 A1 * 10/2006 Okajima ..... 2/77
2006/0277653 A1 * 12/2006 Okajima ..... 2/93
2007/0004303 A1 * 1/2007 Tanaka ..... D02G 3/32 442/182
2007/0074328 A1 * 4/2007 Melhart et al. ..... 2/69
2007/0079419 A1 * 4/2007 Spruill ..... 2/69
2007/0135009 A1 * 6/2007 Liao ..... A41D 31/00 442/209
2007/0271671 A1 * 11/2007 Okajima ..... 2/69
2007/0294801 A1 * 12/2007 Furgerson ..... A41D 1/04 2/115
2008/0047046 A1 2/2008 Maier
2008/0189824 A1 * 8/2008 Rock ..... D04B 1/02 2/69
2008/0196136 A1 * 8/2008 Fellouhe ..... A41D 27/245 2/69
2009/0025115 A1 * 1/2009 Duffy et al. ..... 2/69

OTHER PUBLICATIONS

International Search Report for International (PCT) Patent Application No. PCT/US2010/040982, mailed Sep. 1, 2010 3 pages.
Written Opinion for International (PCT) Patent Application No. PCT/US2010/040982, mailed Sep. 1, 2010 5 pages.
International Preliminary Report on Patentability for International (PCT) Patent Application No. PCT/US2010/040982, mailed Jan. 16, 2012 6 pages.
Extended Search Report for European Patent Application No. 10794835.8, dated Aug. 6, 2015 8 pages.
Notice of Allowance for Canadian Patent Application No. 2,767,779, mailed Feb. 28, 2014, 1 page.

* cited by examiner

JERSEY

CROSS REFERENCE TO RELATED APPLICATION

This application is a national stage application under 35 U.S.C. 371 of PCT Application No. PCT/US2010/040982 having an international filing date of Jul. 2, 2010, which designated the United States, which PCT application claimed the benefit of U.S. Application Ser. No. 61/222,934, filed Jul. 2, 2009, the entire disclosure of each is hereby incorporated herein by reference.

TECHNICAL FIELD

The invention relates to bicycling clothing having elements that enhance the aerodynamic aspects of the cyclist wearing the jersey.

BACKGROUND OF INVENTION

As air is forced to flow around a bicyclist, a low-pressure region is created behind the bicyclist. This creates a turbulent wake as the bicyclist displaces air while moving forward on a bicycle. With a high-pressure region in front and a low-pressure region behind the cyclist, the cyclist is effectively pulled backwards towards the low-pressure region. In this manner, the turbulent wake creates an pressure drag, which combines with surface friction (or skin friction) drag as air passes over the surface of the bicyclist. The pressure drag increases as a square of the cyclist's velocity and the power required to overcome the pressure drag increases as a cube of the cyclist's velocity.

Compared to a bicycle, the cyclist s a much greater surface area with respect to the oncoming air, resulting in greater aerodynamic drag. In addition to assuming an aerodynamic position on the bicycle, the cyclist can reduce one or more of the pressure drag and/or surface friction drag by wearing more aerodynamic apparel.

When in an aerodynamic or "tucked" position, the cyclists' shoulders and upper arms create the most air turbulence and therefore substantially contribute to the aerodynamic drag. Reducing the turbulence created by the cyclists' shoulders and upper arms can substantially reduce the aerodynamic drag. Standard portions of a cycling jersey that create and/or contribute to drag are the portions of sleeves about the cyclist's arms, portions of the jersey about the rib cage, abdomen, chest, and neck of the bicyclist. Less frictional drag translates to faster speeds and greater efficiency of movement. Thus, there is a desire for more aerodynamic sports apparel that can lead a bicyclist to greater efficiency and faster speeds without significant increases in power output, by minimizing the surface friction drag and/or pressure drag.

SUMMARY OF INVENTION

The invention provides an athletic jersey comprising at least one sleeve comprising a shoulder panel and a sleeve panel, and a back panel having first and second back panel lateral edges mated and joined to the sleeve panel of the at least one sleeve, and a front panel having first and second front panel side edges mated and joined to the shoulder panel of the at least one sleeve as well as a collar edge mated and joined to the shoulder panel. The jersey also has side panels mated and joined between the front panel and back panel, such that the side panel comprises a beam element and an arm element, the arm element extending from the beam element, the arm element having a substantially triangular shape extending from the beam element forward about the triceps and armpit area of the jersey to form the at least one sleeve in combination with the shoulder panel and sleeve panel and substantially eliminating loose fabric about the wearer's underarm.

DESCRIPTION OF EMBODIMENTS

Figure 1:
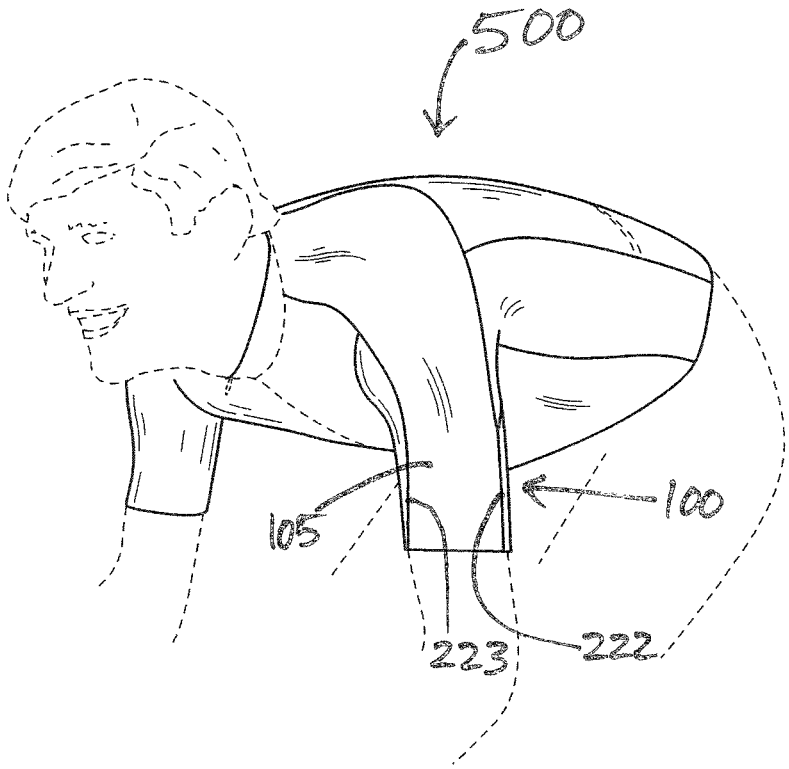
FIG. 1, shows an aerodynamic jersey of the invention as worn by a bicyclist.

The invention provides athletic clothing that covers at least part of the torso of an athlete and has aerodynamically-enhanced features that reduce aerodynamic drag on the athlete.

One aspect of the invention is an aerodynamic sleeve. Another aspect of the invention is a bicycling jersey having an aerodynamic sleeve. Another aspect of the invention is a speed suit in which a jersey, which has an aerodynamic sleeve, is integrated with cycling shorts or pants. FIGS. 1-8 illustrate one preferred embodiment of the aerodynamic sleeve and jersey of the invention.

In one embodiment, the aerodynamic sleeve 100 includes portions of a side panel 104 of the jersey 500 having a beam element 209 and an arm element 208, the arm element 208 extending from the beam element 209. The sleeve panel 106 has opposing bicep sleeve 218 and back sleeve 225 edges. A shoulder panel 105 has opposing back 222 and front 223 shoulder edges, wherein the back sleeve edge 225 is mated and joined to the arm element 208 to form an armpit seam 232 and the back sleeve edge 225 is mated and joined to the back shoulder edge 222 to form a tricep seam 230 and wherein the bicep sleeve edge 218 is mated and joined to a portion of the shoulder front edge 223 to form a bicep seam 229.

Figure 2:
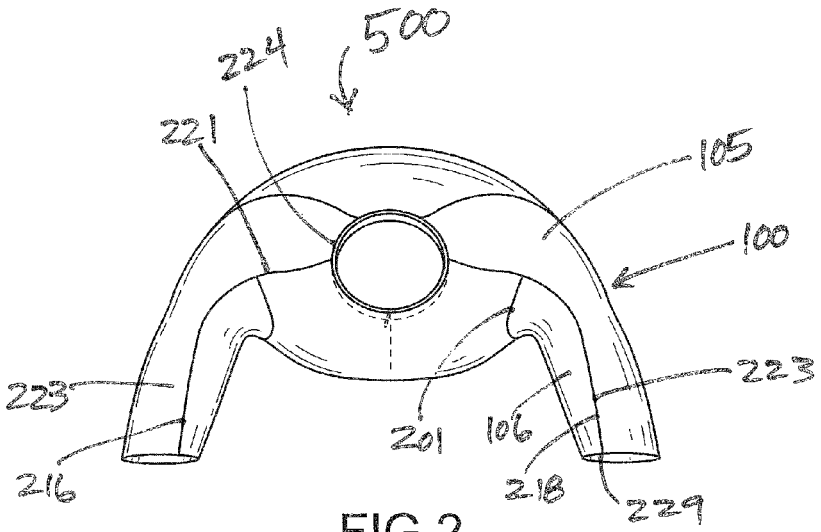
FIG. 2, shows a top view of the aerodynamic jersey of FIG. 1.

As illustrated in FIG. 2, the bicep seam 229 has an arc shape. The arch shape is positioned adjacently about the wearer's bicep from about the bicep lacetus fibrous and/or brachialis muscle to about the wearer's deltoid muscle. The bicep seam arc shape and position about the wearer's bicep substantially reduces one or both of aerodynamic and frictional drag on the arm and shoulder of the bicyclist.

The armpit seam positions about the wearer's tricep and armpit. The position and shape of the armpit seam 232 substantially eliminates loose fabric about the wearer's armpit, thereby substantially reducing aerodynamic and frictional drag associated with air turbulence about the bicyclist's armpit.

The triceps seam positions about wearer's triceps. The position of the tricep seam 230 about the wearer's tricep substantially reduces one or both of aerodynamic and frictional drag on the arm and shoulder of the bicyclist.

Figure 4:
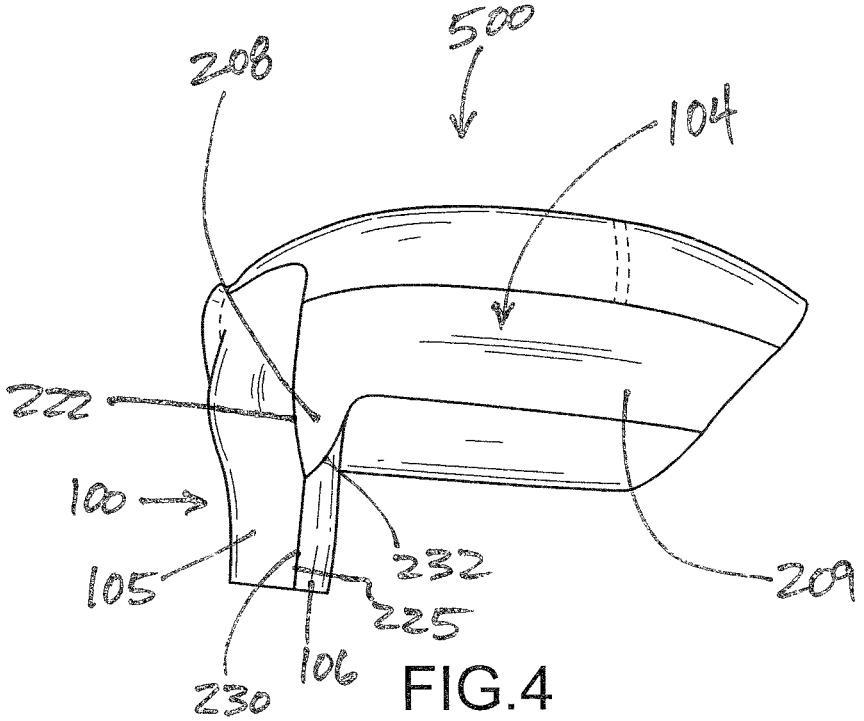
FIG. 4 shows a side view of the aerodynamic jersey of FIG. 1.
Figure 5:
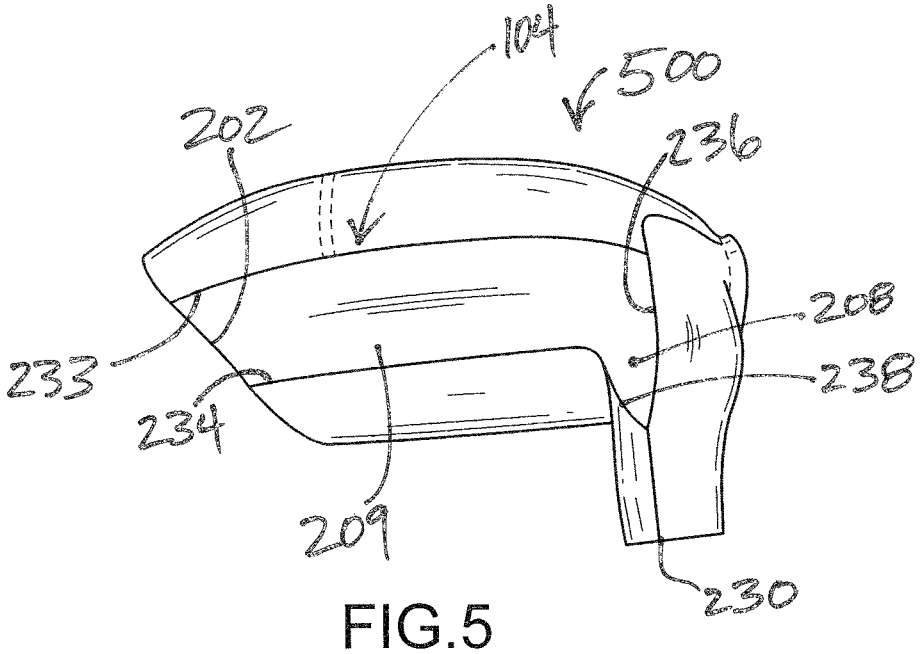
FIG. 5 shows the opposing side view of the aerodynamic jersey of FIG. 4.

In the embodiment illustrated in FIG. 4, the arm element 208 of the side panel 104 has a shape substantially resembling a triangle and the beam element 209 of side panel 104 has a shape substantially resembling a trapezoid. The triangular shape of the arm element 208 extends outward from the beam element 209 trapezoidal shape. In this embodiment, the arm element 208 is positioned at one end of the beam element 209 such that the arm element 208 forms one end of the beam element 209. It will be readily appreciated that the side panel 104 of FIG. 4 is the mirror image of the side panel 104 of FIG. 5, and that all of the elements depicted in the side panels of FIGS. 4 and 5 are present in each of the individual side panels of FIG. 4 and FIG. 5.

Figure 8:
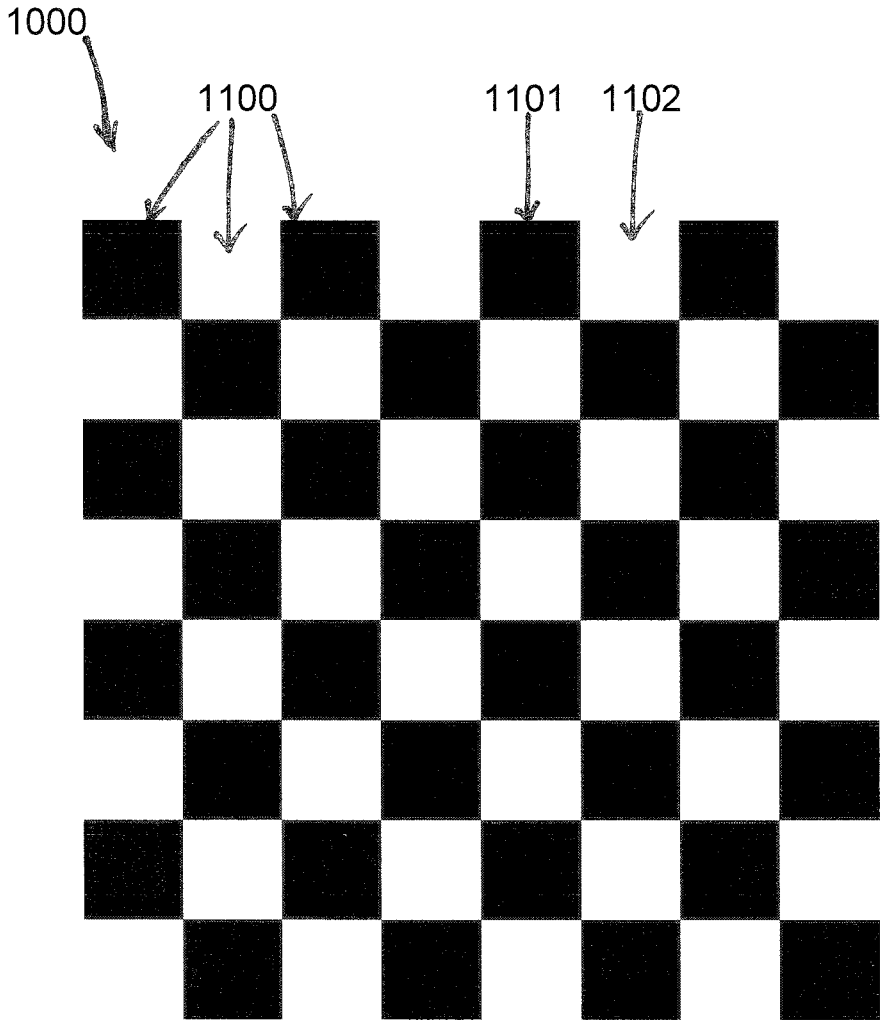
FIG. 8 depicts an alternating checker-board fabric weave pattern useful in the production of components of an aerodynamic jersey of the invention.

In a preferred embodiment, the aerodynamic sleeve 100 comprises an aerodynamic fabric. In a more preferred embodiment, the aerodynamic fabric comprises a fabric having a three-dimensional dimpled texture. It is believed that a three-dimensional dimpled weave texture substantially reduces aerodynamic drag. The three-dimensional dimpled weave texture is believed to reduce drag in the same manner that the dimpled pattern of a golf ball reduces drag. A preferred three-dimensional dimpled weave pattern 1000 is depicted in FIG. 8. The three-dimensional dimpled weave pattern 1000 comprises a plurality of boxes 1100. Each of the boxes has a shape that is substantially square. The three-dimensional dimpled wave pattern 1000 is substantially a checker-board pattern having alternating raised weave components 1101 and lowered weave components 1102. A fabric composed in whole or in one or more portion(s) of such a three-dimensional dimpled weave pattern may be used to fabricate and form any element or portion of an element of an aerodynamic jersey of the invention. Preferably, at least one of the shoulder panel 105 and the sleeve panel 106 include a fabric having a three-dimensional dimpled weave pattern. In a more preferred embodiment, at least one of the shoulder panel 105 and the sleeve panel 106 are composed entirely of a fabric having a three-dimensional dimpled weave pattern. In the most preferred embodiment, both the shoulder panel 105 and the sleeve panel 106 are composed entirely of a fabric having a three-dimensional dimpled weave pattern.

The aerodynamic sleeve(s) of the jerseys of the invention can be of varying lengths to form a full-length sleeve (that is, extend from about the wearer's shoulder to about the wearer's wrist), about a three-quarter length sleeve (that is, extend from about the wearer's shoulder to about a mid-point of the wearer's forearm), a half-sleeve (that is, extended from about the wearer's shoulder to about the wearer's elbow), or a quarter-sleeve (that is, extended from about the wearer's shoulder to about a mid-point on the wearer's upper arm). The full-length sleeve embodiment of the jersey of the invention may also have a glove attached to the end of the sleeve.

In a related embodiment, the aerodynamic sleeve of the invention comprises a stretchable and/or elastic fabric. A fabric having elastic or stretchable properties means the fabric stretches and/or elongates when a tension force is applied to the fabric and when the tension force is removed, the fabric returns substantially to its configuration prior to the application of the tension force. In one configuration, the entire jersey comprises such stretchable and/or elastic fabric, allowing the jersey to substantially conform to the wearer's upper torso when the cyclist is an aerodynamic position on a bicycle. More specifically, the jersey substantially conforms to the wearer's torso with minimal, if any, of one or more of wrinkles, bulges, creases, puckering, ridges, channels or combinations thereof, that may contribute to aerodynamic and/or frictional drag on the wearer when bicycling. As one of skill in the art will readily recognize, the fabric composing portions of the jersey, including the sleeve(s), of the invention may be both stretchable and/or elastic as well as having a three-dimensional dimpled weave pattern. In preferred embodiments, the three-dimensional dimpled weave pattern, where present is also a stretchable and/or elastic material.

Referring to FIG. 5, which, as noted above, is the mirror image of the side panel depicted in FIG. 4, the side panel 104 comprises opposing back 233 and front 234 side panel edges, a side panel shoulder edge 236 and a waist side panel edge 202. The front side panel edge 234 has a triceps side panel edge 238. The arm element 208 portion of the side panel 104 comprises the triceps side panel edge 238 and a portion of the side panel shoulder edge 236 adjacent to the triceps side panel edge 238. The beam element 209 portion of the side panel 104 comprises the front side panel edge 234, the back side panel edge 233, the waist side panel edge 202 and a portion of the side panel shoulder edge 236. The side panel shoulder edge 236 extends along portions of both the beam element 209 portion of the side panel 104 and the arm element 208 portion of the side panel 104.

Figure 6:
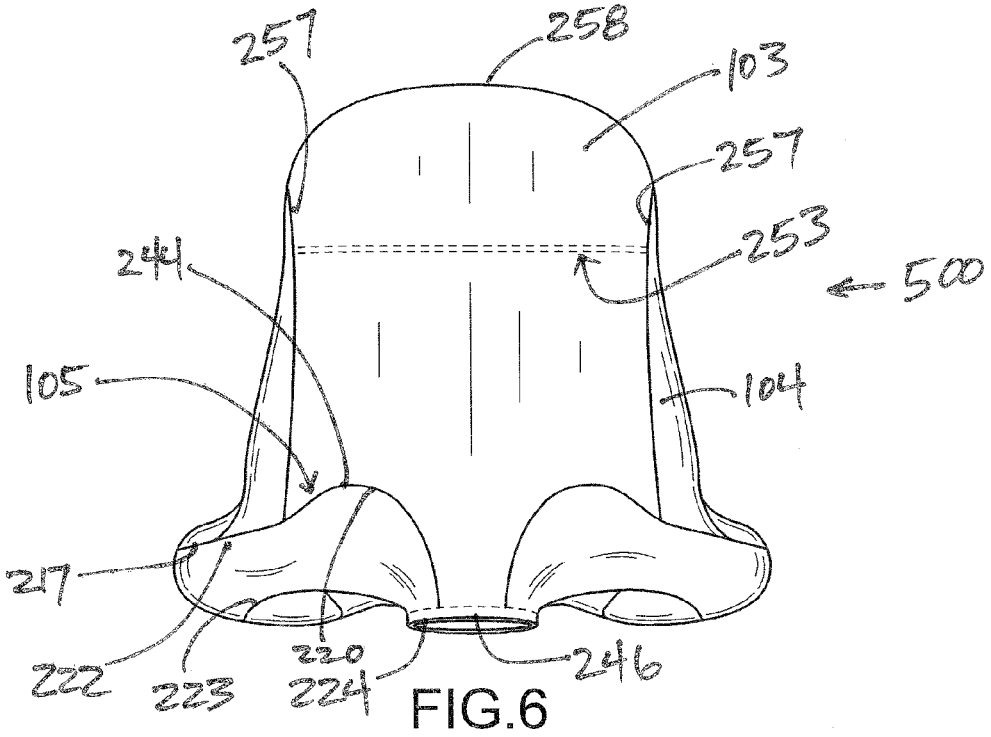
FIG. 6 shows the back of an aerodynamic jersey of FIG. 1.

As depicted in FIG. 6, the shoulder panel 105 comprises opposing back 222 and front 223 shoulder edges, and a collar edge 224. The back shoulder edge 222 includes a triceps edge portion 217 and a back edge portion 220. The shoulder front edge 223 includes a bicep edge portion 216 and a front edge portion 221. The collar edge 224 may be mated and joined to an optional collar. Alternatively in the absence of the optional collar, the collar edge may extend to the edge of the jersey to form a portion of the neck of the jersey of the invention.

Figure 3:
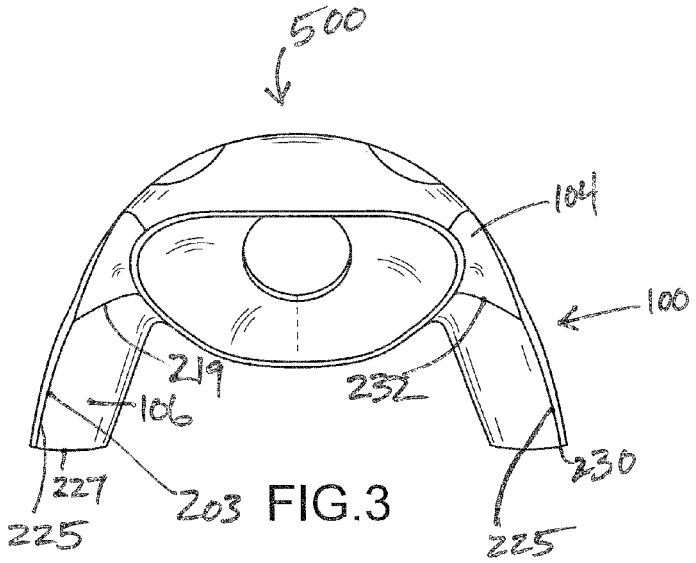
FIG. 3 shows a bottom view of the aerodynamic jersey of FIG. 1.

As depicted in FIGS. 2 and 3, the sleeve panel 106 comprises the opposing bicep sleeve edge 218 and back sleeve edge 225, an arm portion edge 227 and a front panel edge 201. The back sleeve edge 225 includes a triceps sleeve edge 203 and a sleeve side panel edge 219.

Each of the components described above are mated and joined to form the aerodynamic sleeve 100, including the sleeve side panel edge 219 mated and joined to the front side panel edge 238 to form the armpit seam 232, and the triceps sleeve edge 203 mated and joined to the triceps shoulder portion 217 to form the triceps seam 230, and the bicep sleeve edge 218 mated joined to the bicep shoulder portion 216 to form the biceps seam 229.

As depicted in FIG. 6, a back panel 103 having back panel sleeve edges 244 positioned between a back panel collar edge 246 and opposing back panel lateral edges 257, and a back panel waist edge 258. As noted above with respect to the shoulder panel 105, the collar edge 246 of back panel 103 may be mated and joined to an optional collar. Alternatively in the absence of the optional collar, the collar edge 246 may extend to the edge of the jersey to form a portion of the neck of the jersey of the invention.

Figure 7:
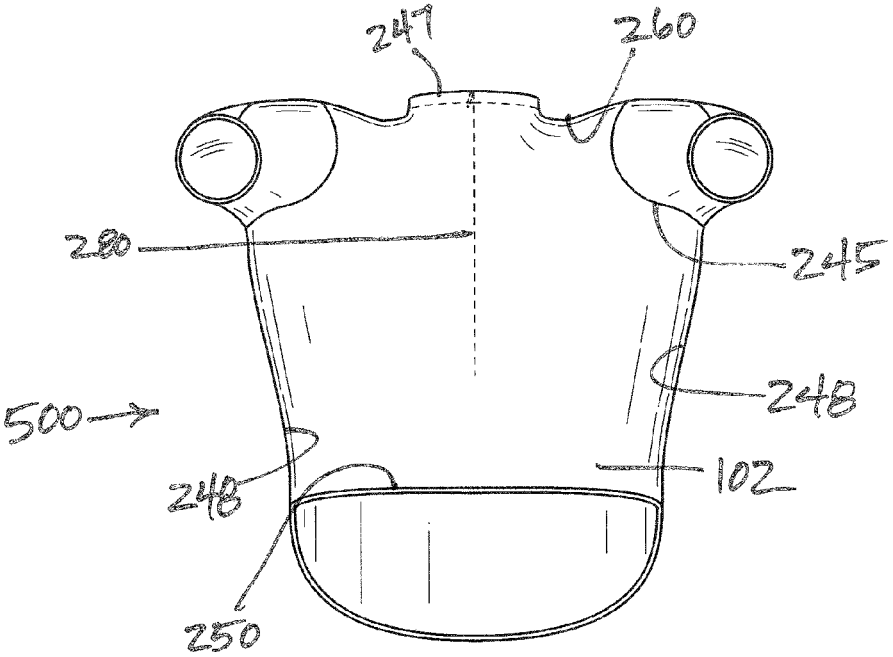
FIG. 7 shows the front of an aerodynamic jersey of FIG. 1.

As depicted in FIG. 7, the front panel 102 has a front panel shoulder edge 260 positioned between a front panel collar edge 247 and a front panel sleeve edge 245, and opposing front panel side edges 248. Preferably, the front panel sleeve edge 245 of the front panel 102 is directly mated and joined to the front panel edge 201 of the sleeve panel 106 along a seam (referred to herein as a "front shoulder seam"). The front panel side edges 248 are positioned between the front panel sleeve edge 245 and the front panel waist edge 250. As noted above with respect to the sleeve panel 105 and the back panel 103, the front panel collar edge 247 may be mated and joined to an optional collar. Alternatively in the absence of the optional collar, the collar edge 247 may extend to the edge of the jersey to form a portion of the neck of the jersey of the invention.

In preferred embodiments, the front panel is shorter in length (as measured from collar to waist) than the back panel. In even more preferred embodiments, the back panel length is greater than the front panel length by a front-to-back distance which is determined for a wearer to substantially reduce and/or eliminate bunching and/wrinkling of the jersey front when the wearer is in an aerodynamic position on a bicycle, thereby substantially reducing and/or eliminating aerodynamic and/or frictional drag associated with the front of the jersey.

As noted above, one embodiment of the jersey of the invention includes a collar forming a neck in the jersey and being mated and joined to the front panel 102, back panel 103, and shoulder panels 105 at front panel collar edge 247, back panel collar edge 246, and shoulder panel collar edges 224, respectively.

An optional embodiment of the jerseys of the invention includes one or more pockets formed in the back panel. As depicted in FIG. 6, one embodiment of such pocket extends across the lower portion of the back panel 103 and opens along pocket access edge 253.

In another optional embodiment, a zipper is positioned in the front panel of the jersey to open from the neck of the jersey to the waist of the front panel. That is, when opened, the zipper of this embodiment separates the front panel into two separate, unconnected portions, each extending from the neck to the waist of the front panel.

In a related optional embodiment, a zipper is positioned in the front panel of the jersey to open from the neck of the jersey to a mid-point in the front panel above the waist of the front panel. That is, when opened, the zipper of this embodiment separates the upper portion of the front panel into two separate, unconnected portions, while the portion of the front panel below the zipper and above the waist remains connected as a continuous fabric. This optional zipper is depicted in FIG. 7 as line 280.

As described above, these zippers can be full zippers, three-quarter zippers, half-zippers, or one-quarter zippers. In preferred embodiments, the zipper is present and is mostly, if not completely, recessed and/or covered to substantially reduce, if not eliminate, turbulence and/or drag due to air flowing over the zipper.

A preferred embodiment of the invention is a bicycling jersey comprising first and second aerodynamic sleeves, a front panel having first and second front panel side panel edges, mated and joined, respectively, to front shoulder edges of the first and second aerodynamic sleeves, a back panel having first and second back panel lateral edges, each mated and joined to back side panel edges of the first and second aerodynamic sleeves, wherein first and second back panel sleeve edges are mated and jointed, respectively, to first shoulder portions of the first and second aerodynamic sleeves, and front panel collar edges of the front panel mated and joined to the first and second aerodynamic sleeves and the back collar edges mated and joined to a collar.

A more preferred embodiment of the invention includes a pocket mated and joined to back panel of the embodiment described in the preceding paragraph. A preferred pocket is joined along the waist edge of the back panel of the jersey and to at least a portion of the first and second back panel lateral edges. In a more preferred embodiment, one or more pocket partition seam(s) divide the pocket into one or more separate pockets.

In a preferred embodiment, the ratio of the length of shoulder panel collar edge 224 to the length of back panel collar edge 246 is greater than about 0.5. In a more preferred embodiment, the ratio of the length of shoulder panel collar edge 224 to the length of back panel collar edge 246 is greater than about 1.0. The inventors have discovered that one or both of the aerodynamic and frictional drags are decreased when the ratio of the shoulder panel distance 240 to the back panel distance 241 is greater than about 0.5 and, preferably greater than about 1.0.

The aerodynamic sleeve shapes and configurations of the embodiments of the invention, configured as either a jersey or a speed suit, substantially reduces air turbulence and/or aerodynamic drag by at least one of:

i) reducing, if not eliminating, one or more of puckering, ridges, wrinkles, or combinations thereof within the underarm regions of the cyclist when the cyclist is in the aerodynamic position;

ii) reducing, if not eliminating, one or of puckering, ridges, wrinkles, or combinations thereof within the shoulder regions of the cyclist when the cyclist is in the aerodynamic position; and iii) reducing, if not eliminating, one or of puckering, ridges, wrinkles, or combinations thereof within the upper arm regions of the cyclist when the cyclist is in the aerodynamic position.

Additionally, the shape and/or placement of the side panels adjacent and extending into the armpit and sleeve portions of the aerodynamic sleeve, as depicted in FIGS. 4 and 5, substantially eliminates and/or reduces a twist of the aerodynamic sleeve when the cyclist is in the aerodynamic position. Furthermore, this shape and placement of the side panel substantially conforms the aerodynamic sleeve 100 to the wearer's underarm, thereby reducing and/or eliminating loose fabric within the underarm area.

The shapes and configurations of the side panels, the shoulder panels and the sleeve panels of the embodiments of the invention described above, configured as either a jersey or a speed suit, when attached to the back, front and collar panels described above conform to the wearer's body when the wearer is in an aerodynamic position on a bicycle thereby reducing at least one of aerodynamic and frictional drag on the wearer.

Similarly, the shape and placement of the shoulder panel on the aerodynamic sleeve as described above substantially reduces air turbulence and/or aerodynamic drag by substantially conforming the aerodynamic sleeve to the cyclist's torso when the cyclist is in an aerodynamic position on a bicycle. Furthermore, the shape and placement of the shoulder panel described above reduces, if not eliminates, winkles within the shoulder portion of the jersey when the cyclist is in the aerodynamic position. The shape of the shoulder panel described above further reduces, if not eliminates, air turbulence created by seams about the cyclist's shoulder region.

As noted above, in certain embodiments, the jerseys of the invention described above may be mated and joined to cycling shorts to from a speed suit.

Another aspect of the invention is a polymeric ribbed component that is adhered to a surface of the shoulder panel. The polymeric ribbed component may be adhered to the outer surface or the inner surface of one or both shoulder panels. The polymeric ribbed component may also be adhered to a portion of the surface of the front panel and/or sleeve panel of the jerseys of the invention. The ribbed component(s) located on the shoulders/sleeves act as wind trips for fluid passing over the torso of a bicyclist in an aerodynamic position on a bicycle. In a specific embodiment, the ribbed component comprises a polymer that is adhered to the surface of the front of the bicycle jersey or speed suit. In a preferred embodiment, the shape of the ribbed component is hemispherical with an upper radius limit of about 3 cm. Alternatively, the shape of the ribbed component may be circular with an upper radius limit of about 3 cm. The ribbed component may be a stretchable tube or a spring, such that when the rider is standing upright, the spring expands, and when the bicyclist assumes an aerodynamic position on a bicycle, the spring compresses to hold a circular or semi-circular shape of the ribbed component.

As used herein, to join fabric means any method for joining fabric known within the art. Non-limiting examples of joining fabric are: sewing (using any appropriate stitching types and/or methods), welding, gluing, adhesive bonding, fusing, and combinations thereof. Furthermore, joining can include fasteners such as, but not limited to, zippers, hooks and loops, buttons, eyelets, and combinations thereof.

The invention, in various embodiments, includes components, and/or methods, substantially as depicted and described herein, including various embodiments, sub-combinations, and subsets thereof. Those of skill in the art will understand how to make and use the invention after understanding the disclosure. The invention, in various embodiments, includes providing devices and processes in the absence of items not depicted and/or described herein or in various embodiments hereof, including in the absence of such items as may have been used in previous devices or processes, e.g., for improving performance, achieving ease and\or reducing cost of implementation.

What is claimed is:

1. A jersey configured to substantially reduce aerodynamic and frictional drag on the arm and shoulder of a bicyclist riding in an aerodynamic position on a bicycle, the jersey comprising:

at least one sleeve comprising:

a shoulder panel having a back shoulder edge and an opposing front shoulder edge; and a sleeve panel having a bicep sleeve edge, an opposing back sleeve edge and a front panel edge;

wherein the back sleeve edge is mated and joined to the back shoulder edge to form a tricep seam and wherein the bicep sleeve edge is mated and joined to a portion of the front shoulder edge to form a bicep seam;

a back panel having first and second back panel lateral edges and a back panel waist edge, wherein the back panel is mated and joined to the shoulder panel of the at least one sleeve, opposite from the back panel waist edge;

a front panel having: first and second front panel side edges, a front panel waist edge, a collar edge opposite from the front panel waist edge, and at least one front panel sleeve edge, wherein the at least one front panel sleeve edge is directly mated and joined to the front panel edge of the sleeve panel of the at least one sleeve along a front shoulder seam; and at least one side panel comprising a waist side panel edge, a shoulder panel edge and front and back panel edges, wherein the at least one side panel is mated and joined between the front panel and back panel and wherein the shoulder panel edge is mated and joined to the shoulder panel; and, wherein the side panel comprises a beam element and an arm element, the arm element extending from the beam element opposite from the waist side panel edge, the arm element having a substantially triangular shape extending from the beam element forward about a triceps and armpit area of the jersey to form the at least one sleeve in combination with the shoulder panel and sleeve panel and configured to substantially eliminate loose fabric about the wearer's underarm.

2. The jersey of claim 1, wherein the at least one sleeve comprises an aerodynamic fabric having a three-dimensional dimpled weave texture.

3. The jersey of claim 2, wherein at least a portion of the shoulder panel comprises the three-dimensional dimpled texture comprising a checker-board pattern having alternating raised components and lowered components, wherein each of the alternating raised and lowered components has a square shape.

4. The jersey of claim 1, wherein the at least one sleeve is selected from the group consisting of a full-length sleeve, a three-quarter length sleeve, a half-sleeve, and a quarter-sleeve.

5. The jersey of claim 1, wherein the at least one sleeve comprises a stretchable fabric that is configured to elongate when a tension force is applied to the fabric.

6. The jersey of claim 1, wherein the back panel is longer than the front panel.

7. The jersey of claim 1, further comprising at least one pocket formed in the back panel.

8. The jersey of claim 1, further comprising a zipper in the front panel.

9. The jersey of claim 1, further comprising cycling shorts mated and joined to the front panel waist edge and the back panel waist edge.

10. The jersey of claim 1, wherein the front shoulder edge of the shoulder panel includes a bicep edge portion and a front edge portion, wherein the front panel includes a front panel shoulder edge, wherein the bicep edge portion of the front shoulder edge is mated and joined to the bicep sleeve edge of the sleeve panel to form the bicep seam and the front edge portion of the front shoulder edge is mated and joined to the front panel shoulder edge of the front panel to form a shoulder seam.

11. The jersey of claim 10, wherein the bicep seam and the shoulder seam form a continuous seam.

12. The jersey of claim 11, wherein the sleeve panel has an arm portion edge, and wherein the continuous seam extends from the collar edge of the front panel to the arm portion edge of the sleeve panel.

* * * * *